US012318670B2

(12) United States Patent
DeMille et al.

(10) Patent No.: US 12,318,670 B2
(45) **Date of Patent: *Jun. 3, 2025**

(54) GOLF CLUB HEAD

(71) Applicant: Topgolf Callaway Brands Corp., Carlsbad, CA (US)

(72) Inventors: Brandon D. DeMille, Carlsbad, CA (US); William C. Watson, Menifee, CA (US); Dominic LeBlanc, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 14 days.

This patent is subject to a terminal disclaimer.

(21) Appl. No.: 18/429,775

(22) Filed: Feb. 1, 2024

(65) Prior Publication Data

US 2024/0198188 A1 Jun. 20, 2024

Related U.S. Application Data

(63) Continuation of application No. 18/377,226, filed on Oct. 5, 2023, which is a continuation of application No. 18/212,612, filed on Jun. 21, 2023, now Pat. No. 11,786,784.

(60) Provisional application No. 63/444,167, filed on Feb. 8, 2023, provisional application No. 63/433,181, filed on Dec. 16, 2022.

(51) Int. Cl.
*A63B 53/04* (2015.01)

(52) U.S. Cl.
CPC ..... *A63B 53/0433* (2020.08); *A63B 53/0437* (2020.08); *A63B 53/0412* (2020.08); *A63B 53/0466* (2013.01); *A63B 2209/02* (2013.01)

(58) Field of Classification Search
CPC .. A63B 53/04; A63B 53/0433; A63B 53/0437
See application file for complete search history.

(56) References Cited

U.S. PATENT DOCUMENTS

| | | | | | |
|---|---|---|---|---|---|
| 4,449,707 | A * | 5/1984 | Hayashi | A63B 53/04 | 473/305 |
| 5,154,425 | A * | 10/1992 | Niskanen | C22C 32/00 | 473/342 |
| 5,364,571 | A * | 11/1994 | O'Connor | C04B 35/622 | 264/29.7 |
| 6,471,604 | B2 * | 10/2002 | Hocknell | A63B 53/02 | 473/345 |
| 6,672,975 | B1 * | 1/2004 | Galloway | A63B 53/0466 | 473/349 |

(Continued)

FOREIGN PATENT DOCUMENTS

| | | | | |
|---|---|---|---|---|
| AU | 2007268213 B2 * | 5/2011 | | |
| CN | 1720081 A * | 1/2006 | | A63B 53/0466 |
| KR | 20070064331 A * | 6/2007 | | |

*Primary Examiner* — Alvin A Hunter
(74) *Attorney, Agent, or Firm* — Michael A. Catania

(57) ABSTRACT

A golf club head with a central body component is disclosed herein. The central body component includes a crown portion and a sole portion. The crown portion is composed of a continuous carbon fiber reinforced epoxy material. The sole portion is composed of a chopped carbon fiber reinforced vinyl ester sheet molding compound material. The central body component has a front opening and a rear opening with a hollow interior.

10 Claims, 21 Drawing Sheets

(56) References Cited

U.S. PATENT DOCUMENTS 6,723,279 B1 * 4/2004 Withers ..... C22C 1/1036 419/14
7,070,517 B2 * 7/2006 Cackett ..... A63B 53/0466 473/348
7,147,576 B2 * 12/2006 Imamoto ..... A63B 53/0466 473/335
7,163,470 B2 * 1/2007 Galloway ..... A63B 60/02 473/345
7,413,520 B1 * 8/2008 Hocknell ..... A63B 60/02 473/345
7,549,935 B2 * 6/2009 Foster ..... A63B 53/0466 473/335
8,491,416 B1 * 7/2013 Demille ..... A63B 53/04 473/348
9,757,629 B2 * 9/2017 Seluga ..... A63B 53/0466
9,868,036 B1 * 1/2018 Kleinert ..... A63B 53/06
9,908,014 B1 * 3/2018 Wester ..... A63B 60/00
10,035,049 B1 * 7/2018 Nielson ..... A63B 60/52
10,086,240 B1 * 10/2018 Hoffman ..... A63B 60/00
11,786,784 B1 * 10/2023 DeMille ..... A63B 53/0433 473/347
2005/0233831 A1 * 10/2005 Ezaki ..... A63B 60/02 473/345
2007/0293348 A1 * 12/2007 Hocknell ..... A63B 53/047 473/349
2009/0143168 A1 * 6/2009 Bennett ..... A63B 60/02 473/345
2010/0048316 A1 * 2/2010 Honea ..... A63B 53/0466 473/282
2012/0270676 A1 * 10/2012 Burnett ..... A63B 53/04 473/346
2017/0340932 A1 * 11/2017 Morales ..... A63B 53/0466
2018/0345099 A1 * 12/2018 Harbert ..... A63B 53/0433
2019/0151721 A1 * 5/2019 Morales ..... A63B 60/02
2019/0224533 A1 * 7/2019 Spackman ..... A63B 53/045
2020/0114229 A1 * 4/2020 Milleman ..... A63B 60/02
2020/0122003 A1 * 4/2020 Milleman ..... A63B 60/006
2021/0162280 A1 * 6/2021 Morales ..... A63B 53/0466
2021/0339096 A1 * 11/2021 Milleman ..... A63B 60/02

* cited by examiner

GOLF CLUB HEAD

CROSS REFERENCES TO RELATED APPLICATIONS

The Present Application is a continuation application of U.S. patent application Ser. No. 18/377,226, filed on Oct. 5, 2023, which is a continuation application of U.S. patent application Ser. No. 18/212,612, filed Jun. 21, 2023, now U.S. Pat. No. 11,786,784, issued on Oct. 17, 2023, which claims priority to U.S. Provisional Patent Application No. 63/444,167 filed on Feb. 8, 2023, and claims priority to U.S. Provisional Patent Application No. 63/433,181 filed on Dec. 16, 2022, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with a carbon based central body component.

Description of the Related Art

The prior art discloses the use of carbon fiber components for golf club heads.

The products of inertia relate moments about one axis with head rotations about another axis. These head rotations in turn cause vertical or horizontal gear effect that impart increased or reduced backspin and draw or fade spin to a golf ball. Unlike the spins generated by conventional gear effect associated with Iyy and Izz, these spins cannot be compensated for by adjusting the face bulge radius and the face roll radius. As club heads become larger than 300 cc, and moments of inertia become larger, Izz greater than 3000 grams centimeter squared and Iyy greater than 1800 grams, there is a propensity for the products of inertia to also become larger. As the products of inertia become larger, there is a deleterious effect on dispersion.

Thus, there is a need for a large volume golf club head with large moments of inertia, that have smaller products of inertia. This need is difficult to meet since large products of inertia are by-products of large moments of inertia

BRIEF SUMMARY OF THE INVENTION

One aspect of the present invention is a component for a golf club head comprising a crown portion composed of a first carbon based material and a sole portion composed of a second carbon based material.

Another aspect of the present invention is a component for a golf club head. The component comprises a crown portion and a sole portion. The crown portion is composed of a continuous carbon fiber reinforced epoxy material. The crown portion has a thickness ranging from 0.025 inch to 0.040 inch. The sole portion is composed of a chopped carbon fiber reinforced vinyl ester sheet molding compound material. The sole portion has a thickness ranging from 0.040 inch to 0.240 inch. The crown portion is attached to the sole portion. The component has a front opening and a rear opening with a hollow interior.

Yet another aspect of the present invention is a golf club head. The golf club head comprises a face component, a central body component and an aft-component. The component comprises a crown portion and a sole portion. The crown portion is composed of a continuous carbon fiber reinforced epoxy material. The crown portion has a thickness ranging from 0.025 inch to 0.040 inch. The sole portion is composed of a chopped carbon fiber reinforced vinyl ester sheet molding compound material. The sole portion has a thickness ranging from 0.040 inch to 0.240 inch. The crown portion is attached to the sole portion, The component has a front opening and a rear opening with a hollow interior. The face component is attached to a front opening of the central body and the aft component is attached to a rear opening of the central body.

Yet another aspect of the present invention is a golf club head. The golf club head comprises a face component, a central body component and an aft-component. The component comprises a crown portion and a sole portion. The crown portion is composed of a continuous carbon fiber reinforced epoxy material. The crown portion has a thickness ranging from 0.025 inch to 0.040 inch. The sole portion is composed of a chopped carbon fiber reinforced vinyl ester sheet molding compound material. The sole portion has a thickness ranging from 0.040 inch to 0.240 inch. The crown portion is attached to the sole portion, The component has a front opening and a rear opening with a hollow interior. The face component is attached to a front opening of the central body and the aft component is attached to a rear opening of the central body Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
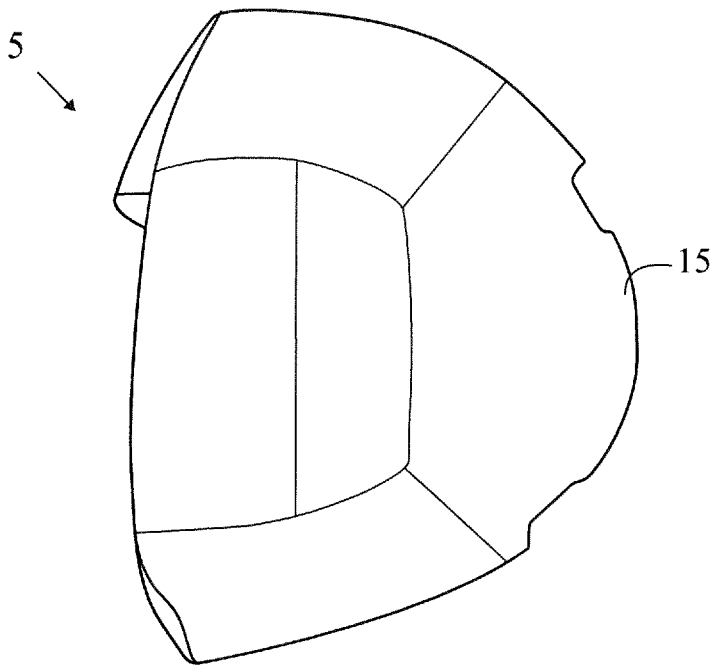
FIG. 1 is a top plan view of a component of a golf club head.
Figure 2:
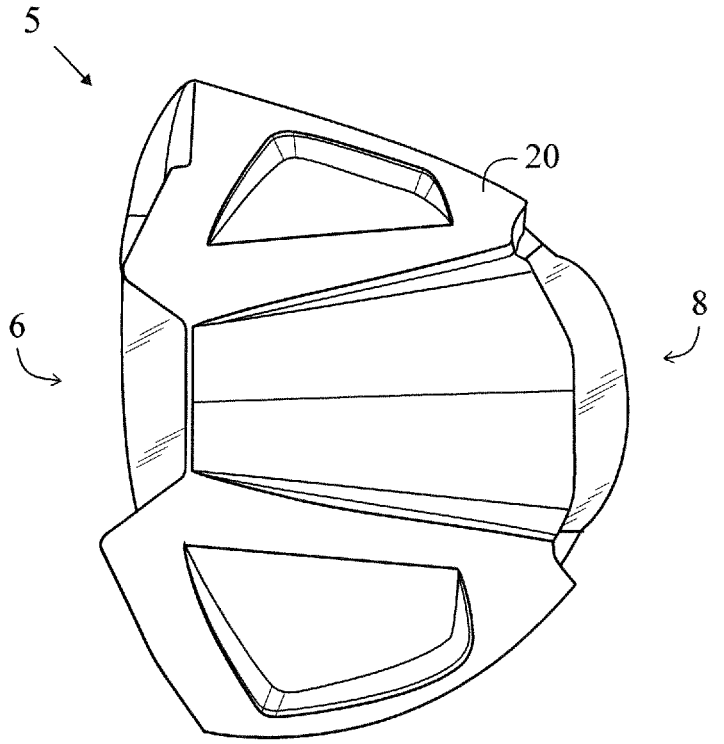
FIG. 2 is a bottom plan view of the component of FIG. 1.
Figure 3:
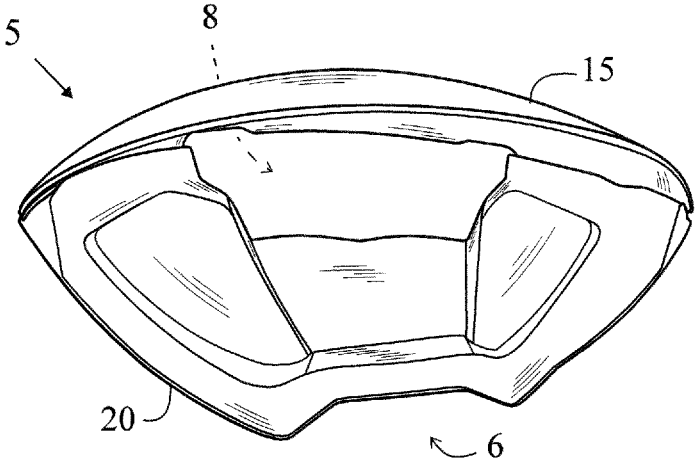
FIG. 3 is a front elevation view of the component of FIG. 1.
Figure 4:
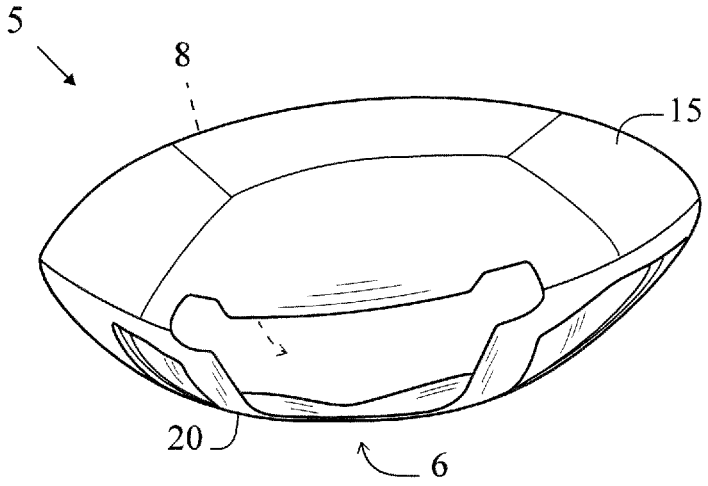
FIG. 4 is a rear elevation view of the component of FIG. 1.
Figure 5:
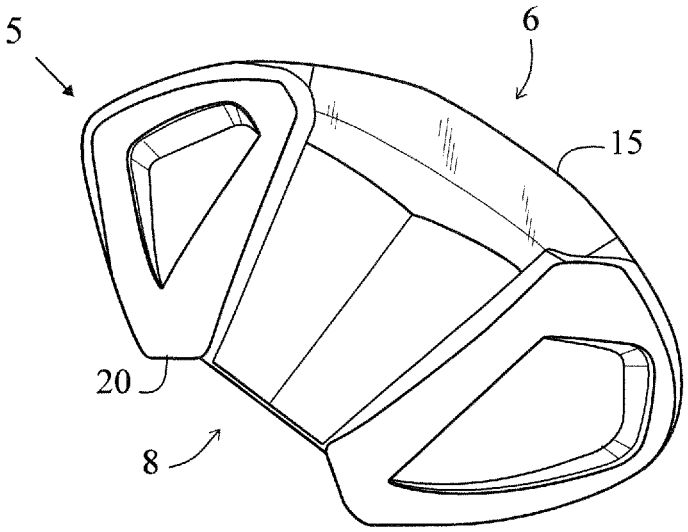
FIG. 5 is a bottom perspective view of the component of FIG. 1.
Figure 6:
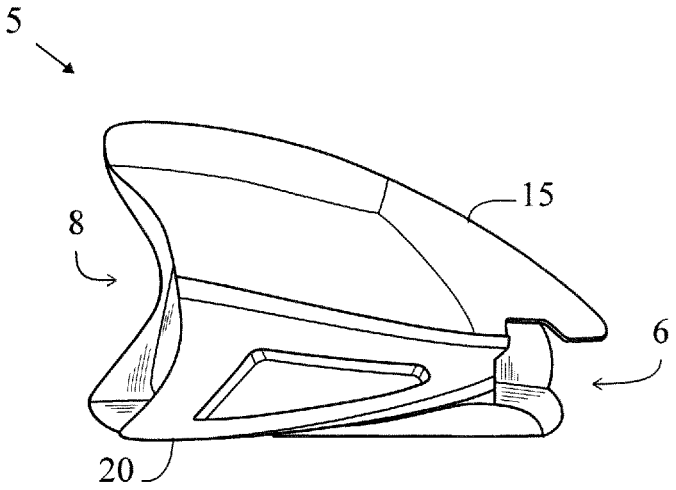
FIG. 6 is a side elevation view of the component of FIG. 1.

As shown in FIGS. 1-8, a component 5 for a golf club head comprises a crown portion 15 and a sole portion 20. The crown portion 15 is composed of a continuous carbon fiber reinforced epoxy material and has a thickness ranging from 0.025 inch to 0.040 inch. The sole portion 20 is composed of a chopped carbon fiber reinforced vinyl ester sheet molding compound material and has a thickness ranging from 0.040 inch to 0.240 inch. The crown portion 15 is attached to the sole portion 20. The component 5 has a front opening 6 and a rear opening 8 with a hollow interior.

Figure 7:
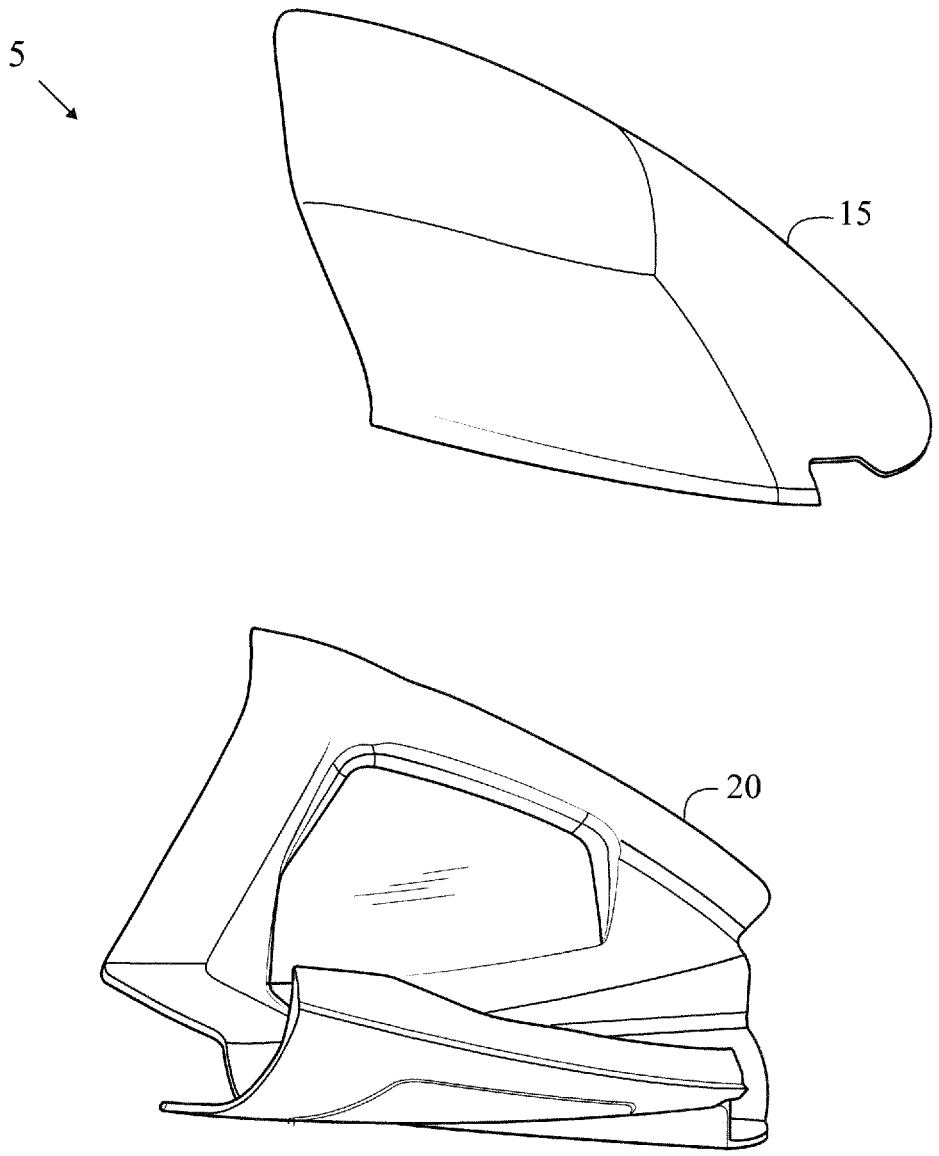
FIG. 7 is an exploded view of the component of FIG. 1.

FIG. 7 is an exploded view of the component 5.

Figure 8:
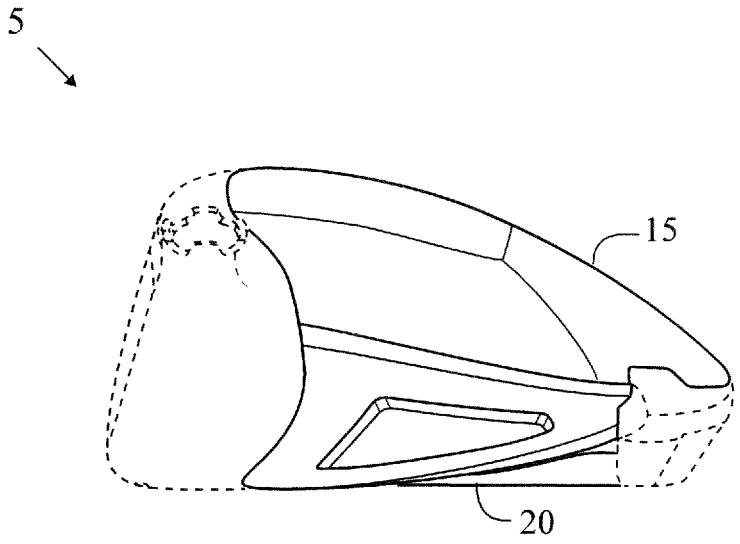
FIG. 8 is a side elevation view of the component of FIG. 1 with a face component and rear weighting component in dashed lines.

FIG. 8 shows the component 5 with a face component attached to a central body and a rear weighting component, both in dashed lines.

Preferably, the sole portion is thicker than the crown portion.

Preferably, the first carbon based material has continuous fibers and the second carbon based material has chopped fibers.

Figure 9:
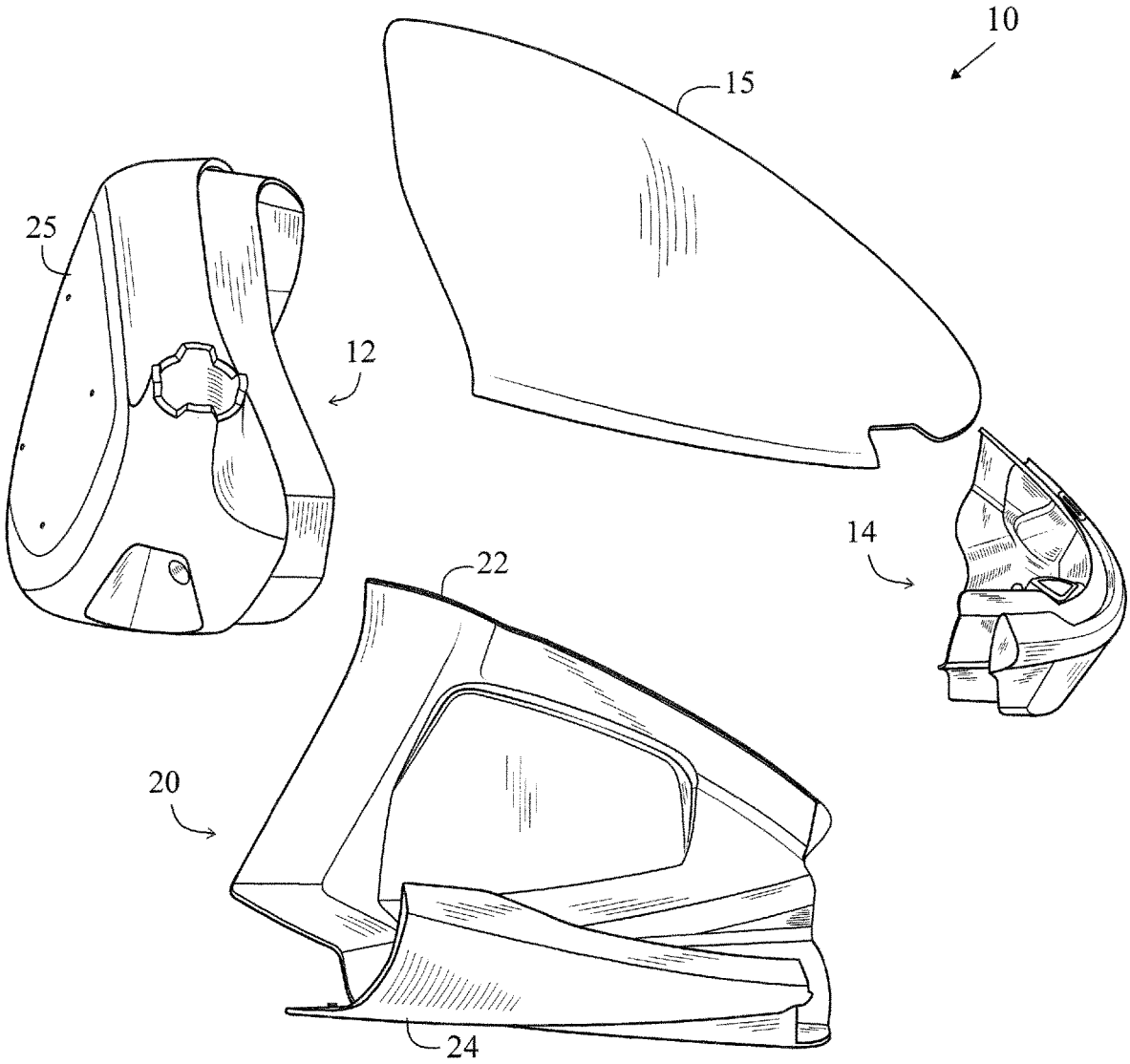
FIG. 9 is an exploded view of a multiple component golf club head.
Figure 10:
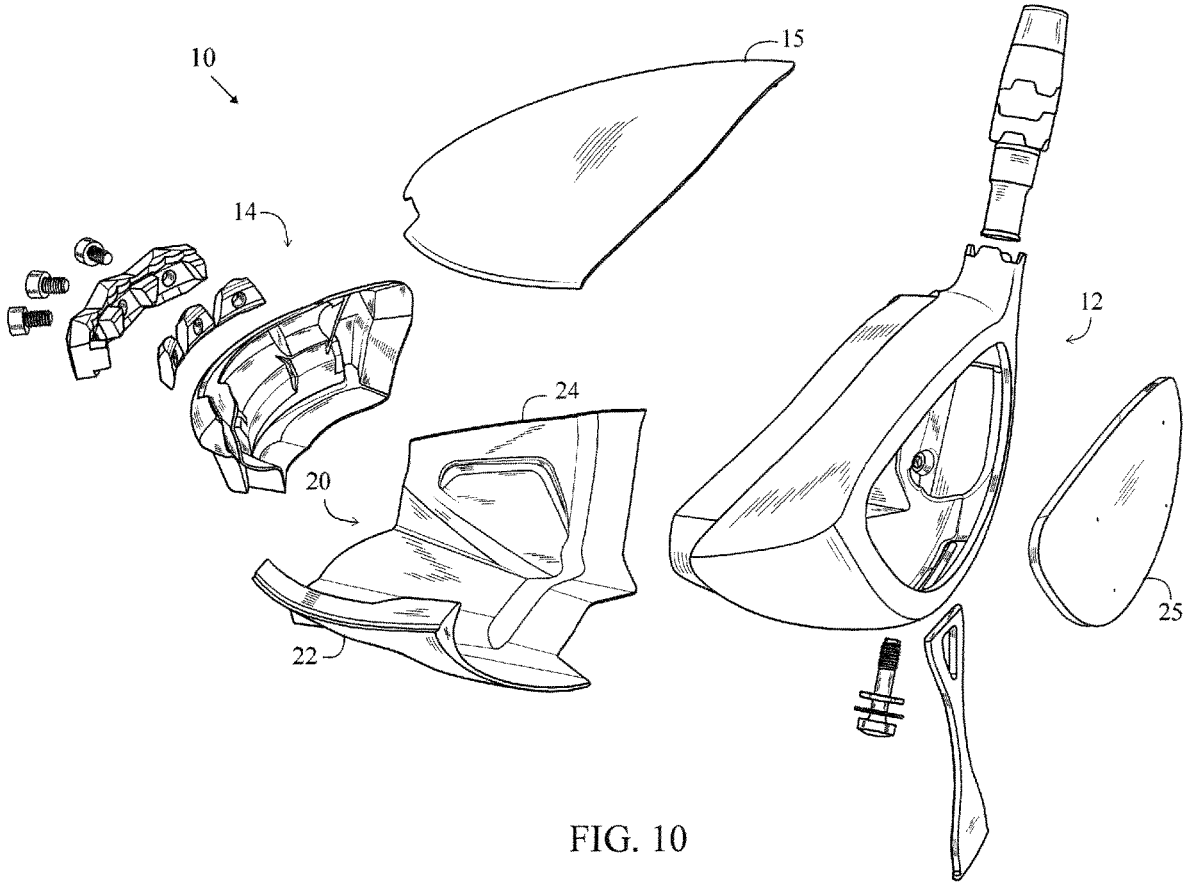
FIG. 10 is an exploded view of a multiple component golf club head
Figure 11:
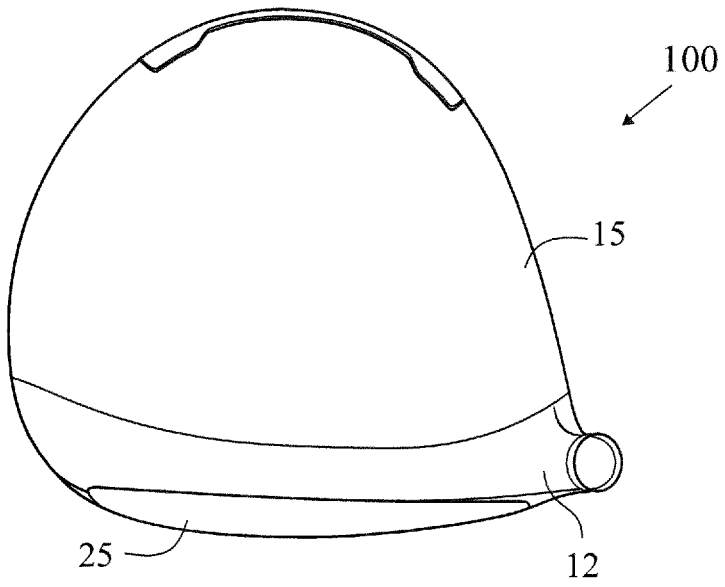
FIG. 11 is a top plan view of a first embodiment of a golf club head.
Figure 12:
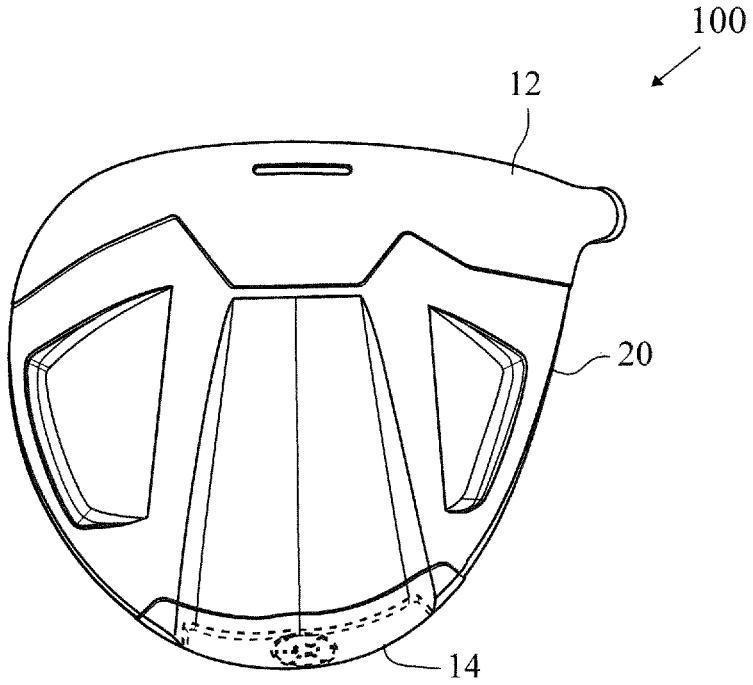
FIG. 12 is a bottom plan view of the golf club head of FIG. 11.
Figure 13:
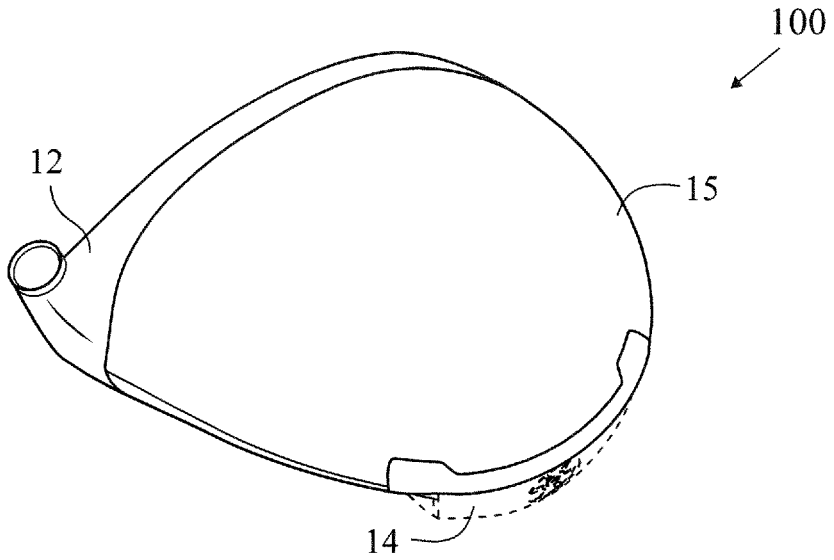
FIG. 13 is a top perspective view of the golf club head of FIG. 11.
Figure 14:
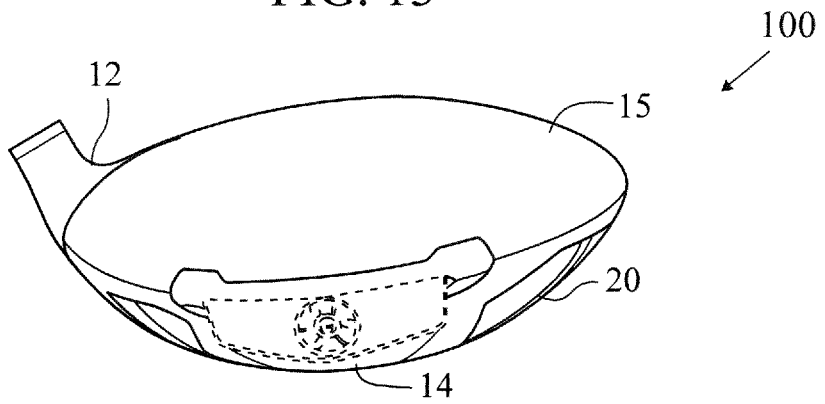
FIG. 14 is a rear elevation view of the golf club head of FIG. 11.
Figure 15:
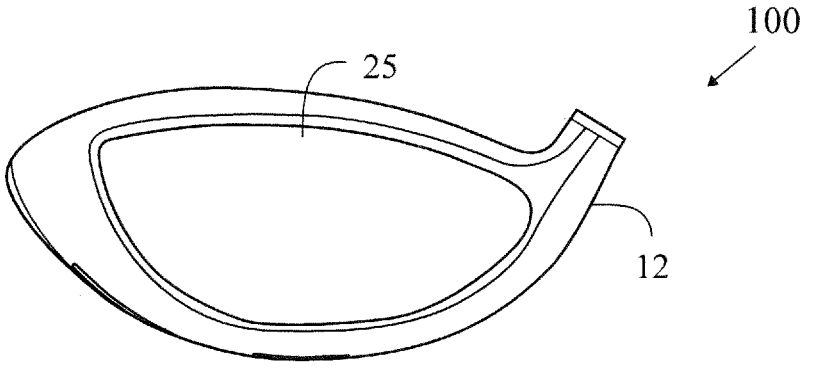
FIG. 15 is a front elevation view of the golf club head of FIG. 11.
Figure 16:
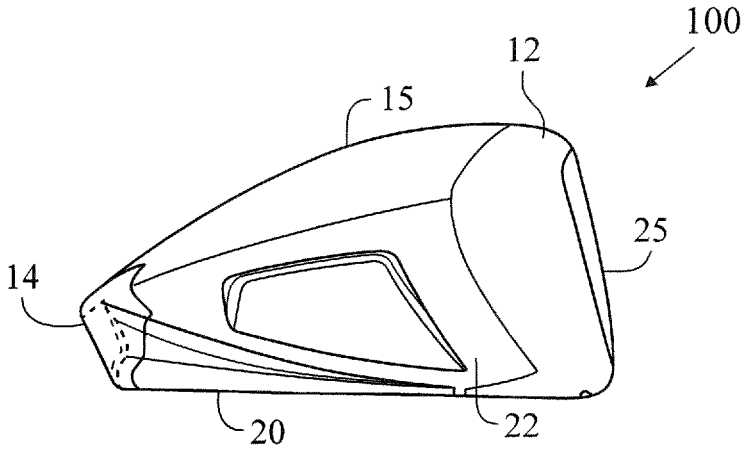
FIG. 16 is a toe-side elevation view of the golf club head of FIG. 11.
Figure 17:
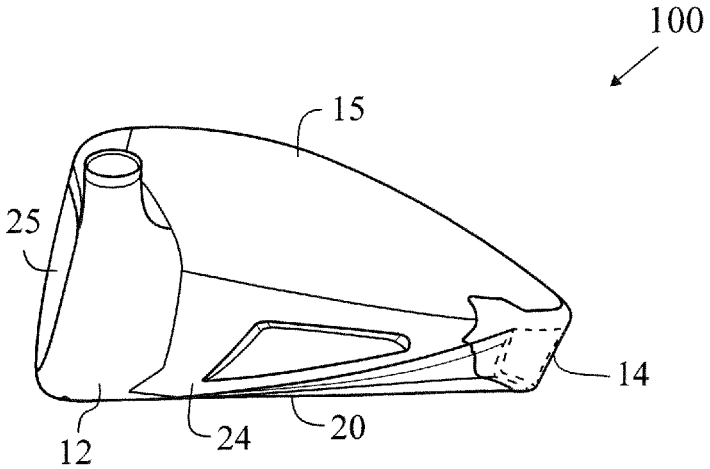
FIG. 17 is a heel-side elevation view of the golf club head of FIG. 11.
Figure 18:
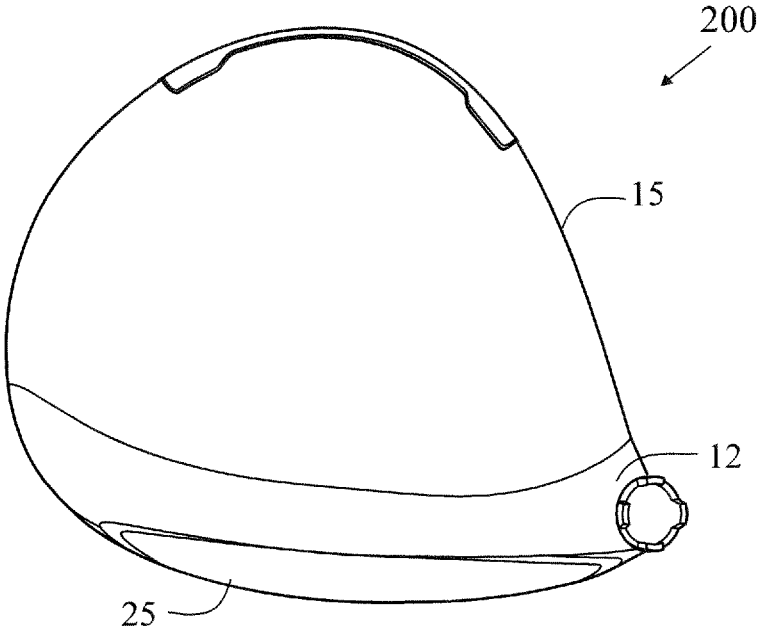
FIG. 18 is a top plan view of a second embodiment of a golf club head.
Figure 19:
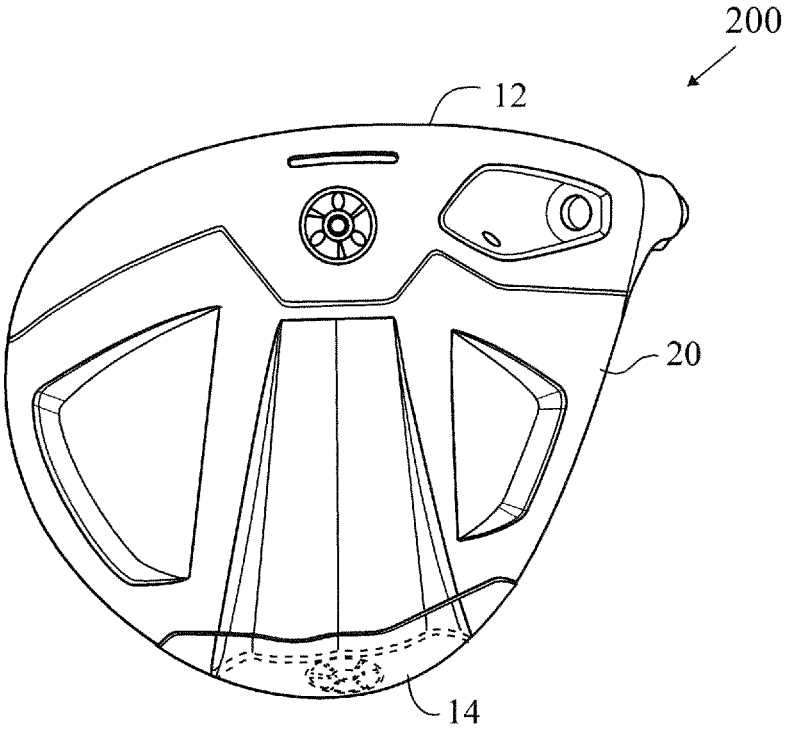
FIG. 19 is a bottom plan view of the golf club head of FIG. 18.
Figure 20:
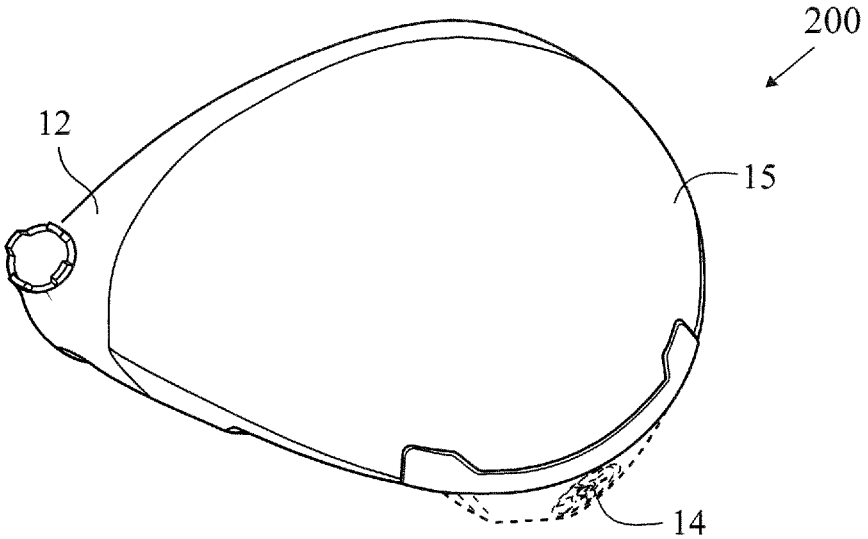
FIG. 20 is a top perspective view of the golf club head of FIG. 18.
Figure 21:
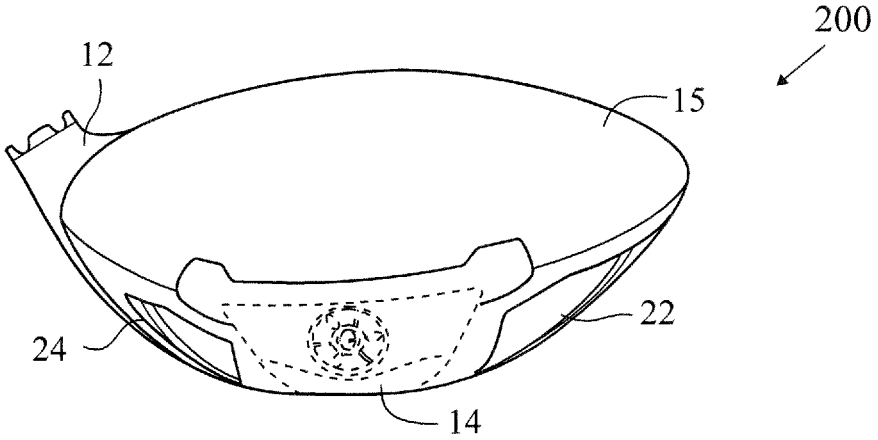
FIG. 21 is a rear elevation view of the golf club head of FIG. 18.
Figure 22:
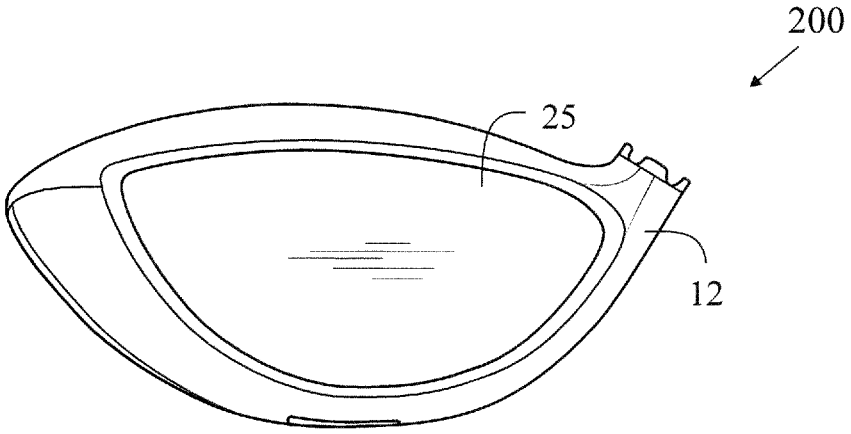
FIG. 22 is a front elevation view of the golf club head of FIG. 18.
Figure 23:
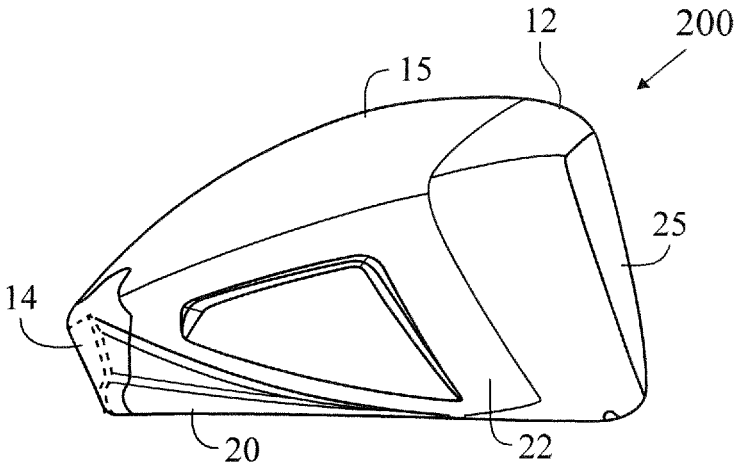
FIG. 23 is a toe-side elevation view of the golf club head of FIG. 18.
Figure 24:
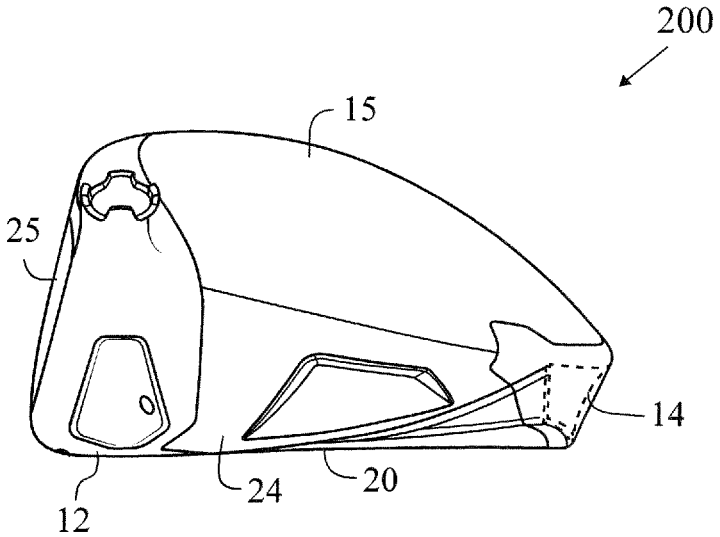
FIG. 24 is a heel-side elevation view of the golf club head of FIG. 18.
Figure 25:
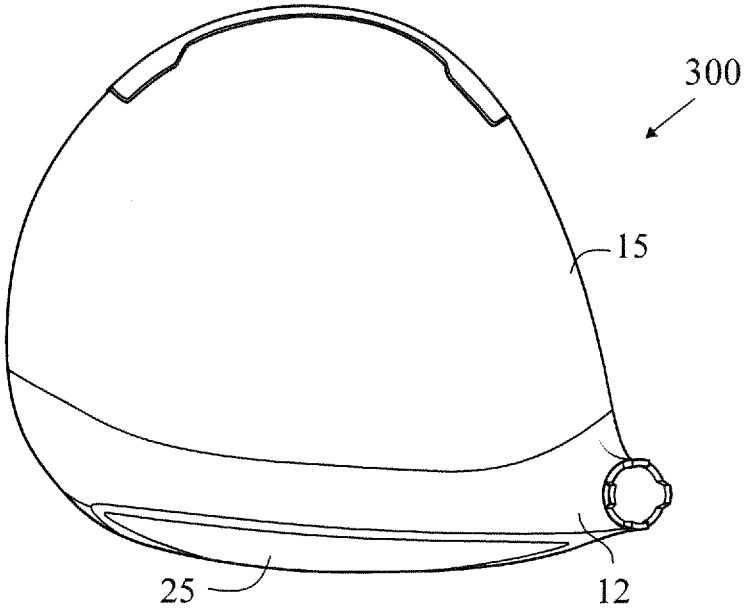
FIG. 25 is a top plan view of a third embodiment of a golf club head.
Figure 26:
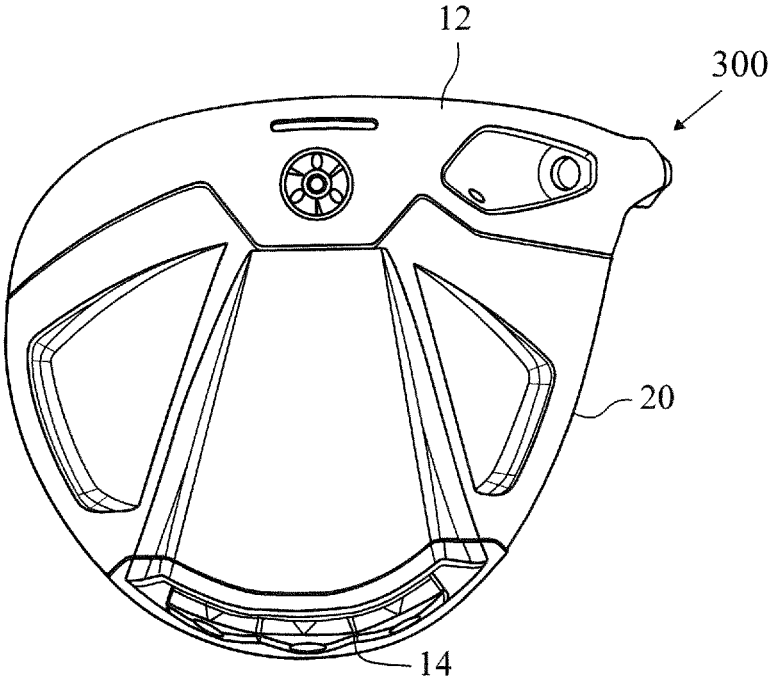
FIG. 26 is a bottom plan view of the golf club head of FIG. 25.
Figure 27:
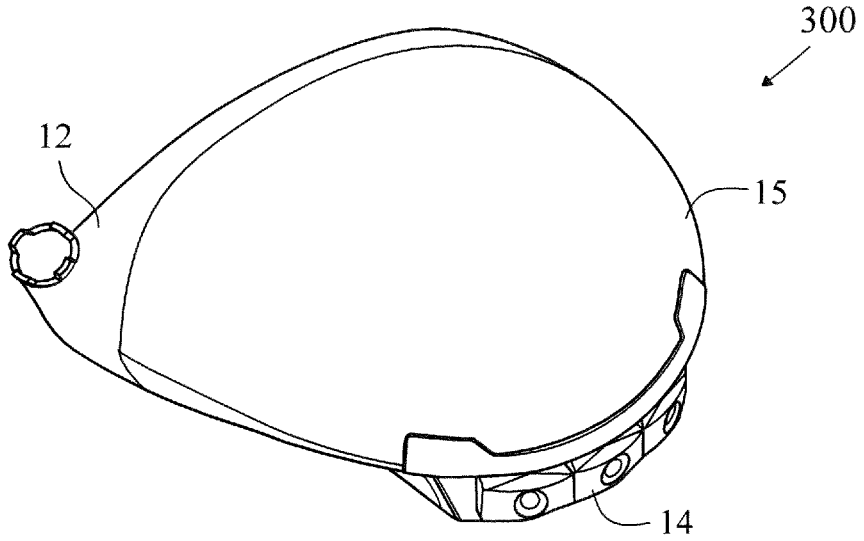
FIG. 27 is a top perspective view of the golf club head of FIG. 25.
Figure 28:
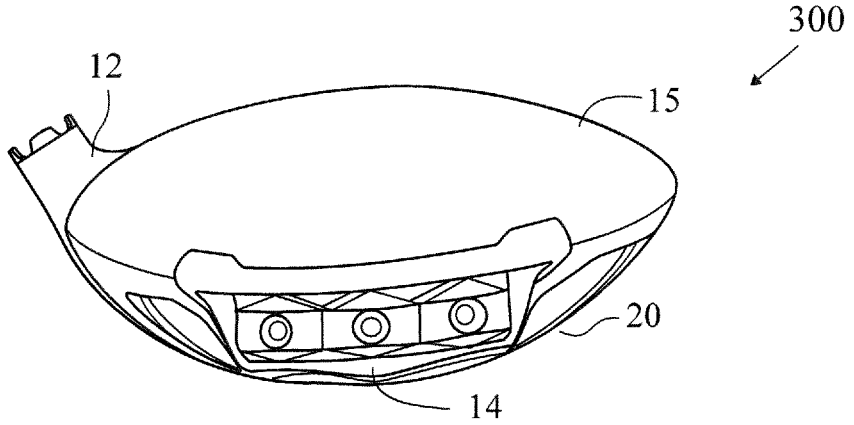
FIG. 28 is a rear elevation view of the golf club head of FIG. 25.
Figure 29:
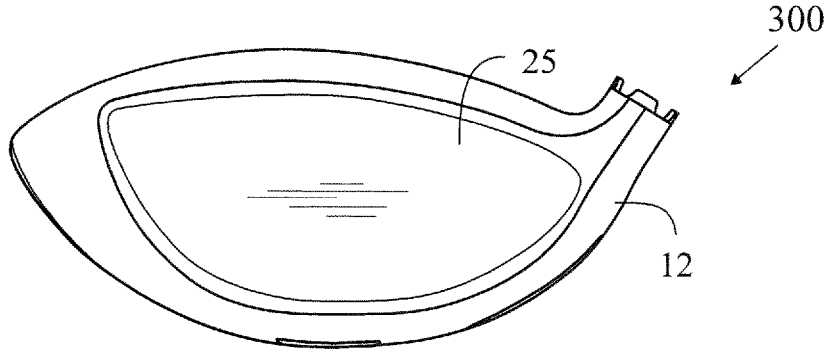
FIG. 29 is a front elevation view of the golf club head of FIG. 25.
Figure 30:
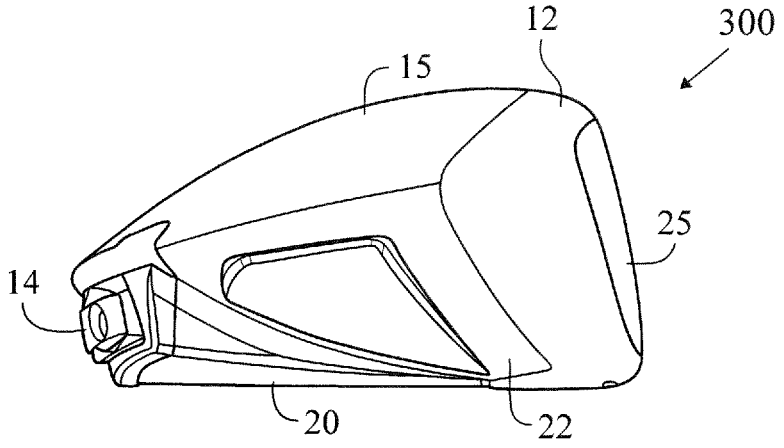
FIG. 30 is a toe-side elevation view of the golf club head of FIG. 25.
Figure 31:
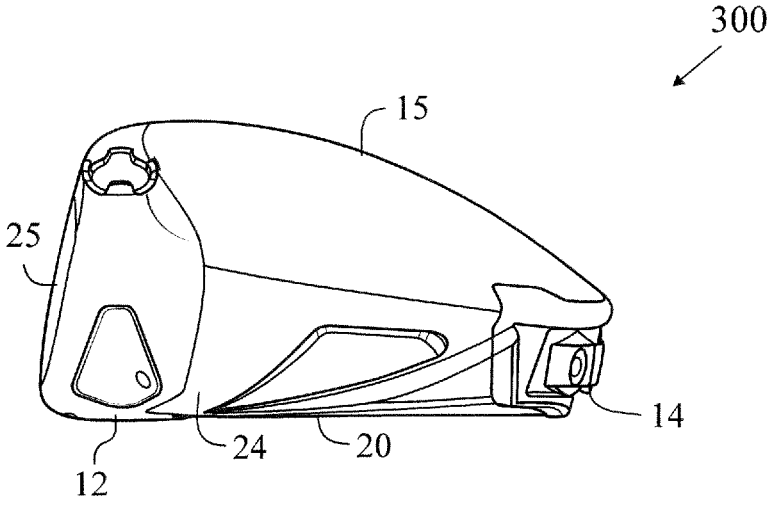
FIG. 31 is a heel-side elevation view of the golf club head of FIG. 25.
Figure 32:
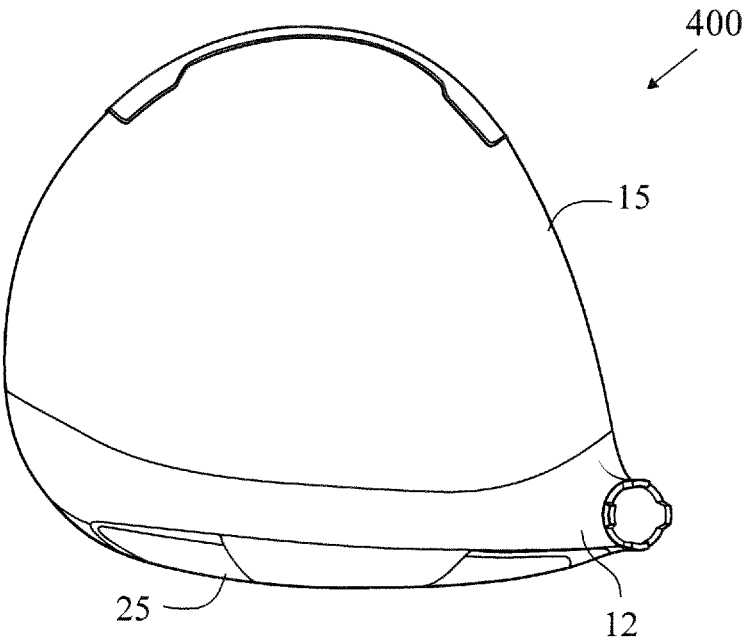
FIG. 32 is a top plan view of a fourth embodiment of a golf club head.
Figure 33:
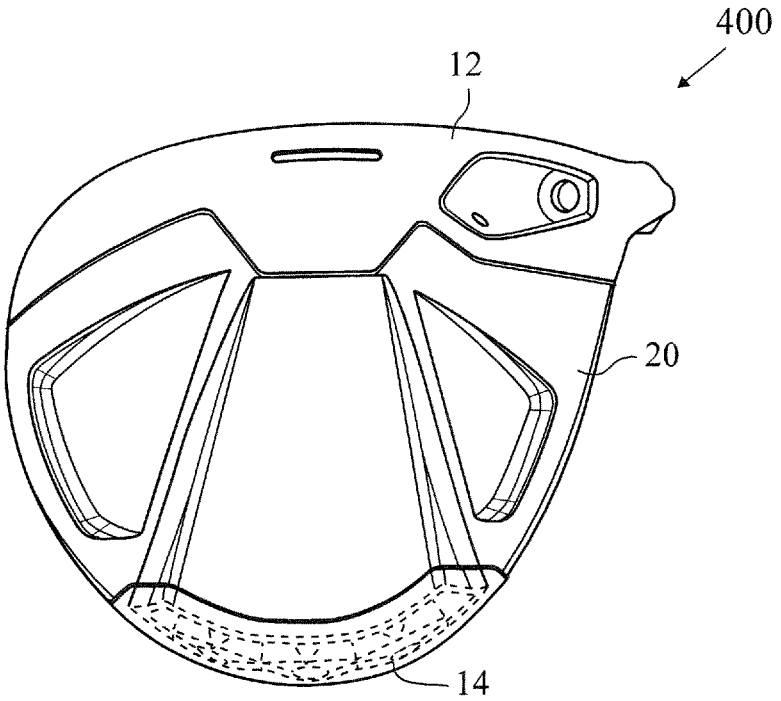
FIG. 33 is a bottom plan view of the golf club head of FIG. 32.
Figure 34:
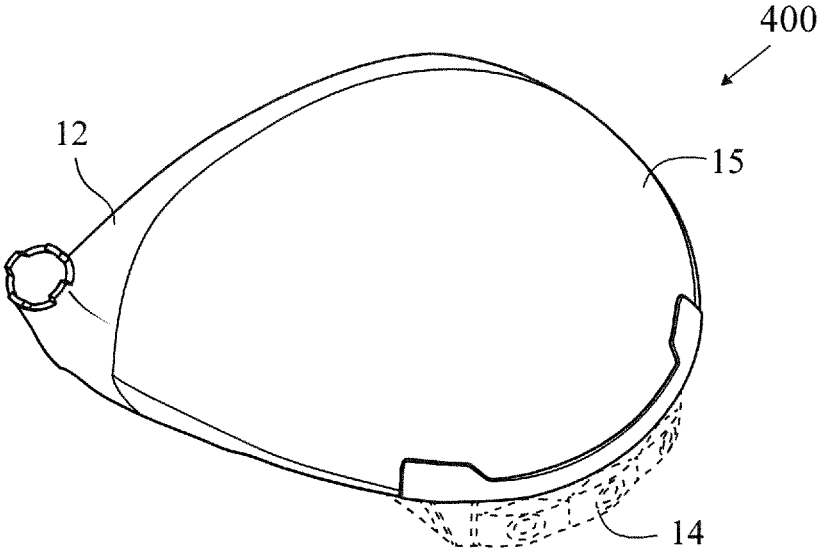
FIG. 34 is a top perspective view of the golf club head of FIG. 32.
Figure 35:
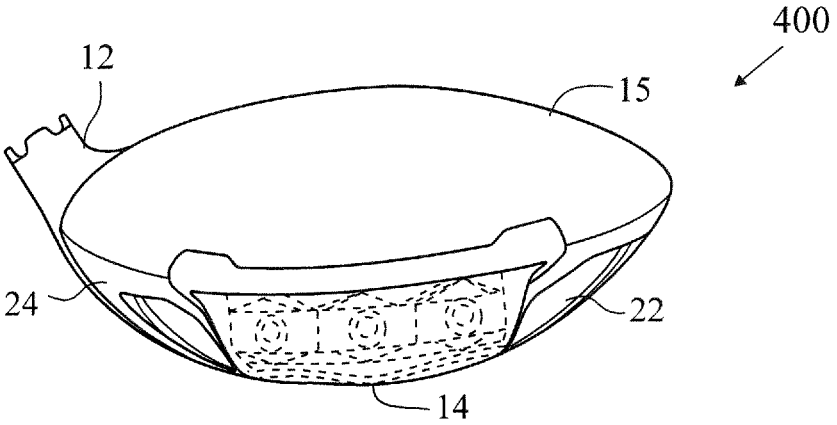
FIG. 35 is a rear elevation view of the golf club head of FIG. 32.
Figure 36:
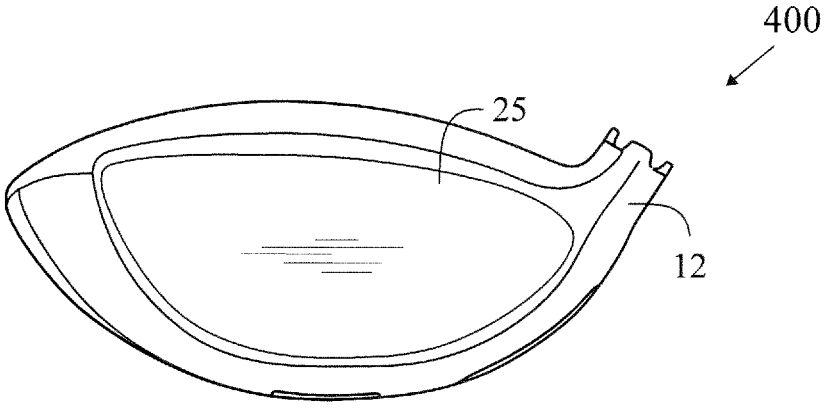
FIG. 36 is a front elevation view of the golf club head of FIG. 32.
Figure 37:
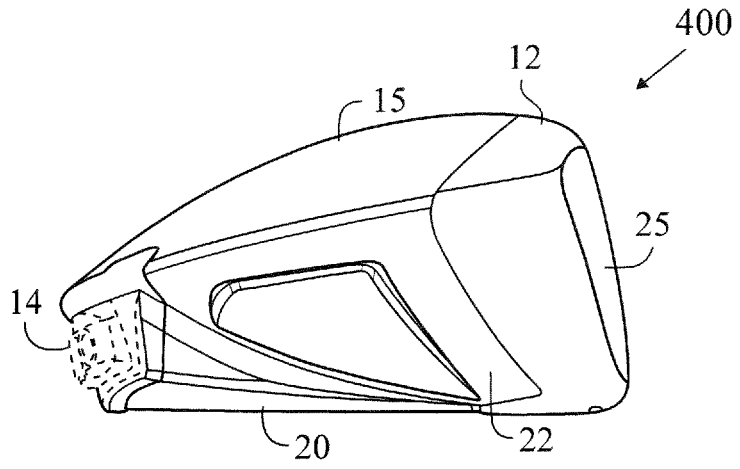
FIG. 37 is a toe-side elevation view of the golf club head of FIG. 32.
Figure 38:
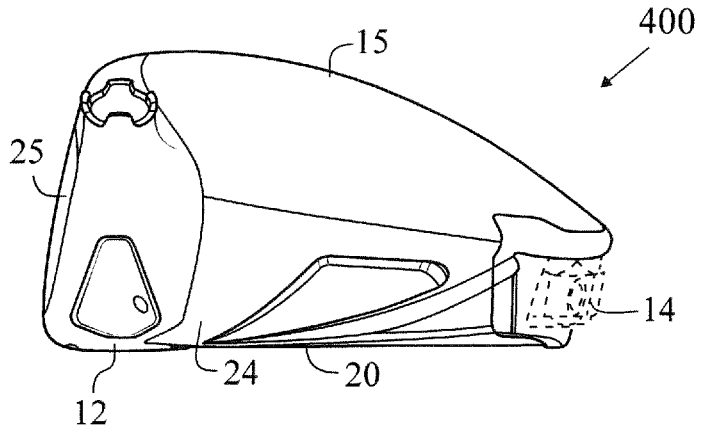
FIG. 38 is a heel-side elevation view of the golf club head of FIG. 32.

The sole portion 20 has a toe edge wall 22 and a heel edge wall 24, as shown in FIGS. 9-10.

The crown portion 15 has a radius of curvature.

The sole portion 20 has a plurality of facets.

In another embodiment, a golf club head 10 comprises a face component 25, a central body component 12, and an aft-component 14, as shown in FIGS. 9-17.

The face component 25 is attached to a front opening of the central body 12 and the aft component 14 is attached to a rear opening of the central body 12.

The central body component 12 comprises a crown portion 15 composed of a continuous carbon fiber reinforced epoxy material, with a thickness ranging from 0.025 inch to 0.040 inch and a sole portion 20 composed of a chopped carbon fiber reinforced vinyl ester sheet molding compound material, with a thickness ranging from 0.040 inch to 0.240 inch. The crown portion 15 is attached to the sole portion 20. The component has a front opening and a rear opening with a hollow interior.

Preferably, the face component 25 is composed of a metal material.

Preferably, the aft-component 14 is composed of a metal material.

Alternatively, the face component 25 is composed of a titanium alloy material.

FIGS. 11-17 illustrate another embodiment of a golf club head 100.

FIGS. 18-24 illustrate another embodiment of a golf club head 200.

FIGS. 25-31 illustrate another embodiment of a golf club head 300.

FIGS. 32-38 illustrate another embodiment of a golf club head 400.

Figure 39:
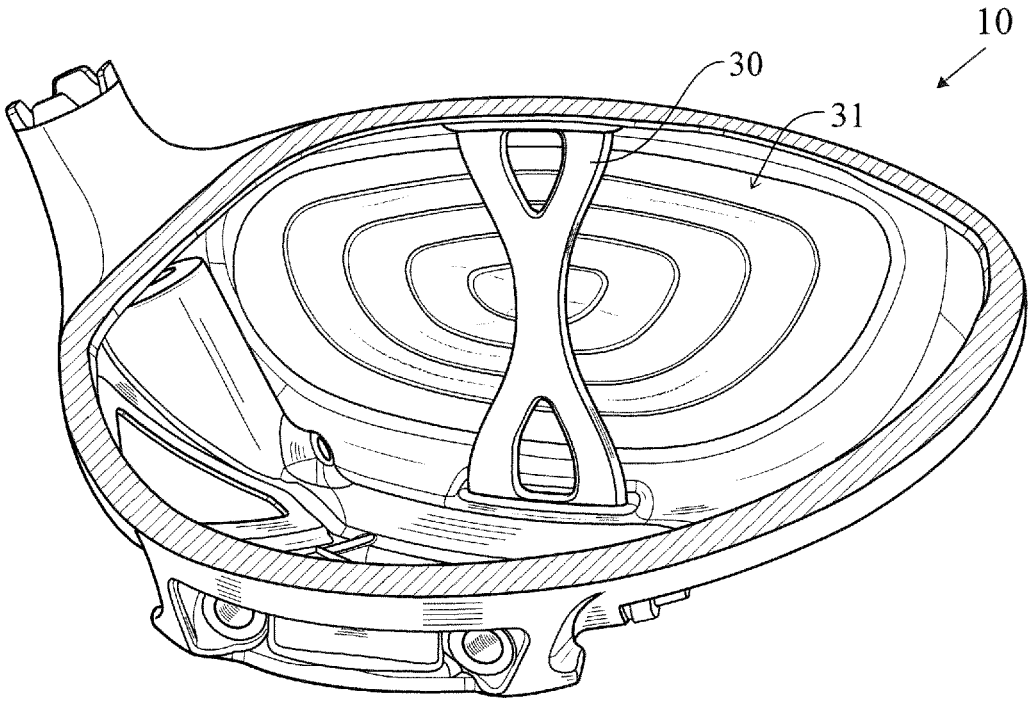
FIG. 39 is an illustration of a first embodiment of a stress relief component.
Figure 40:
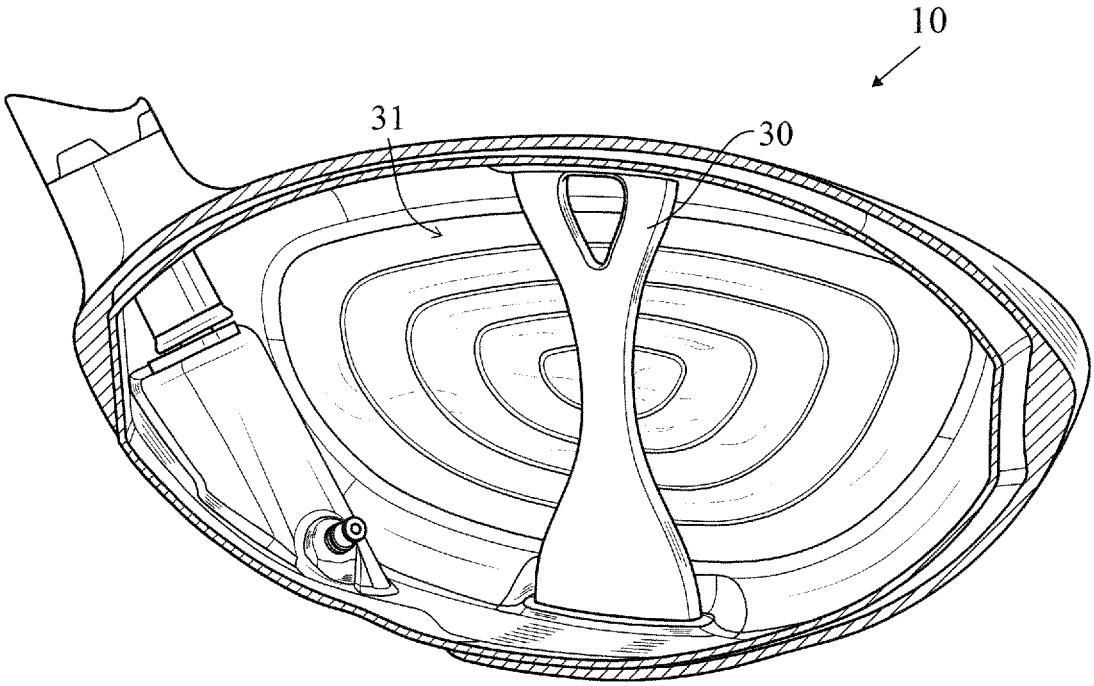
FIG. 40 is an illustration of a second embodiment of a stress relief component.

As shown in FIGS. 39-40, the stiffening member 30 in the preferred embodiment comprises a wishbone structure.

The stiffening member 30 preferably is completely located within 1 inch, and more preferably within 0.500 inch, and most preferably within approximately 0.433 inch of the interior surface 31 of the striking face section, measured along a vertical plane extending through the face center perpendicular to the striking face section and in a front-to-back direction. Locating the stiffening member 30 within the region of the golf club head 10 defined above has the greatest stress-reducing effect on the golf club head 10, and particularly the striking face section. In a preferred embodiment, the stiffening member 30 has a height ranging from 2 inches to 3 inches, and most preferably 2.25 inches to 2.75 inches. In a preferred embodiment, the stiffening member 30 has a narrowest width at a center, which preferably ranges from 0.1 inch to 0.25 inch, and a widest width at a bottom, which preferably ranges from 0.5 inch to 1.0 inch.

The stiffening members 30 of the present invention may be used as described herein in any type of golf club head with a hollow interior, including putters, irons, wedges, hybrids, fairway woods, and drivers. In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In fact, in the preferred embodiment, the golf club head 10 has a volume of approximately 450 cc to 460 cc. The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams. The mass of the body, and thus the overall discretionary mass of the golf club head 10, can be adjusted by creating a cutout in the sole section and filling it with an insert composed of a lightweight material such as carbon composite, plastic, or a low density metal alloy. Similarly, the crown insert can be formed of a carbon composite material to free up additional discretionary mass

Composite Laminate–UD

Individual layers or plies in the composite laminate may be comprised of a unidirectional (UD) composite layer or a fabric consistent of a bi-axial of tri-axial woven composite. For the purpose of this invention, the fiber reinforcement in the composite material system may include carbon, fiberglass, aramid or any combination of the three.

The number of layers or plies in a stack of a composite laminate of the present invention can vary between 2 and 200 plies. A composite laminate with several layers. Each composite ply may be a composite of either UD, bi-axial or tri-axial woven composite. The fabric area weight (FAW) of each composite ply can range from 20 gsm up to 500 gsm. The fiber reinforcement in the composite material for each ply may include carbon, fiberglass, aramid or any combination of the three. The matrix material that is combined with the fiber bundles of each ply to create the composite material of the present invention can be of a thermosetting (epoxy, polyester, vinyl ester, etc.) or a thermoplastic (nylon, polycarbonate, PPS, PEKK, PEEK, etc.) material. Cross-sections of a UD composite panel and a UD and multi-axial composite laminate, respectively, show different layers.

Composite Laminate–SMC

In some embodiments, the composite may be sheet molding compound (SMC), which may be comprised of chopped fibers. Each chopped fiber has a length less than 0.0625 or a length that is no less than 2 inches and no more than 4 inches.

The SMC of the present invention has the following qualities: the fiber reinforcement of the SMC may include carbon, fiberglass, aramid or any combination of the three; the matrix material that is combined with the fiber bundles of each ply to create the composite material of the present invention can be a thermosetting (epoxy, polyester, vinyl ester, etc.) or a thermoplastic (nylon, polycarbonate, PPS, PEKK, PEEK, etc.) material; and the thickness of the SMC may vary between 0.015" to 0.250".

Composite Laminate+SMC

As it pertains to this invention, the use of continuous and discontinuous materials may be used within the same composite component. Following equation 2, the Contiuous Fiber_Ratio quantifies the amount of continuous fiber there is in the laminate compared to the discontinuous fiber or SMC.

VACNTs can be placed at the interface of composite plies in order to improve interlaminar shear strength while also improving overall fatigue life. VACNTs bridge the various composite plies, improving the interlaminar properties of the interfaces as well as arresting crack propagation or pre-failure modes at the interlaminar level. As it relates to this invention, the length of the VACNTs may vary between 5 and 50 μm. VACNTs of the present invention have the following qualities: the VACNTs height can vary between 5 and 50 μm; the VACNTs are applied on a single side of a composite ply; the VACNTs are applied on both sides of a composite ply; and the Additive_Laminate_Ratio can vary between 0.05 and 0.90.

When the golf club head is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head has a volume of approximately 450 cc to 460 cc. The volume of the golf club head will also vary between fairway woods (preferably ranging from 3-woods to eleven woods) with smaller volumes than drivers. When designed as a driver, the golf club head preferably has a mass of no more than 215 grams, and most preferably a mass of 180 to 215 grams; when designed as a fairway wood, the golf club head preferably has a mass of 135 grams to 200 grams, and preferably from 140 grams to 165 grams.

In each of the embodiments disclosed herein, a face component is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the face component is composed of 17-4 steel alloy. Additional methods for manufacturing the face component include forming the body from a flat sheet of metal, superplastic forming the face component from a flat sheet of metal, machining the face component from a solid block of metal, electrochemical milling the face component from a forged pre-form, casting the body using centrifugal casting, casting the face component using levitation casting, and like manufacturing methods.

The face component preferably has a return portion that extends laterally rearward from the perimeter of the front wall. The return portion of the face component preferably includes an upper lateral section, a lower lateral section, a heel lateral section and a toe lateral section. Thus, the return portion preferably encircles the striking plate insert a full 360 degrees. However, those skilled in the pertinent art will recognize that the return portion may only encompass a partial section of the striking plate insert, such as 270 degrees or 180 degrees, and may also be discontinuous.

The upper lateral section extends rearward, towards the central body component, a predetermined distance, d, to engage the crown. In a preferred embodiment, the predetermined distance ranges from 0.2 inch to 1.0 inch, more preferably 0.40 inch to 0.75 inch, and most preferably 0.68 inch, as measured from the perimeter of the striking plate insert to the rearward edge of the upper lateral section. In a preferred embodiment, the upper lateral section has a general curvature from the heel end to the toe end. The upper lateral section has a length from the perimeter of the striking plate insert that is preferably a minimal length near the center of the striking plate insert, and increases toward the toe end and the heel end. However, those skilled in the relevant art will recognize that the minimal length may be at the heel end or the toe end.

The face component engages the crown portion of the central body component along a substantially horizontal plane with some curvature. The return portion has an undercut portion, and a front end of the crown portion is placed over the undercut portion.

The heel lateral section is substantially perpendicular to the striking plate insert, and the heel lateral section covers the hosel before engaging an optional ribbon section and a bottom section of the sole portion of the central body component. The heel lateral section is attached to the sole portion. The heel lateral section preferably extends inward a distance, d'", from the perimeter a distance of 0.250 inch to 1.50 inches, more preferably 0.50 inch to 1.0 inch, and most preferably 0.950 inch. The heel lateral section preferably has a general curvature at its edge.

At the other end of the face component is the toe lateral section. The toe lateral section is attached to the sole portion. The toe lateral section extends inward a distance, d", from the perimeter a distance of 0.250 inch to 1.50 inches, more preferably 0.75 inch to 1.30 inch, and most preferably 1.20 inch. The toe lateral section preferably has a general curvature at its edge.

The lower lateral section of the face component extends inward, toward the central body component, a predetermined distance to engage the sole portion. In a preferred embodiment, the predetermined distance ranges from 0.2 inch to 1.25 inches, more preferably 0.50 inch to 1.10 inch, and most preferably 0.9 inch, as measured from the perimeter of the striking plate insert to the edge of the lower lateral section. In a preferred embodiment, the lower lateral section has a general curvature from the heel end to the toe end. The lower lateral section has a length from the perimeter of the striking plate section that is preferably a minimal length near the center of the striking plate section, and increases toward the toe end 38 and the heel end.

Figure 41:
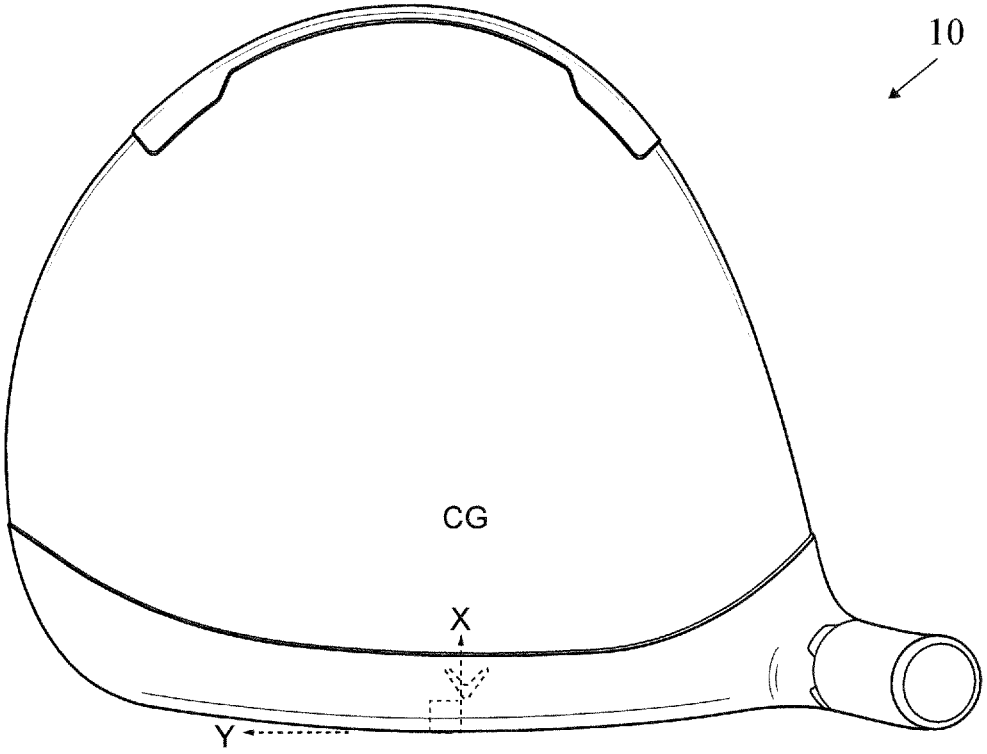
FIG. 41 is a top plan view of a golf club head showing a CG location.
Figure 42:
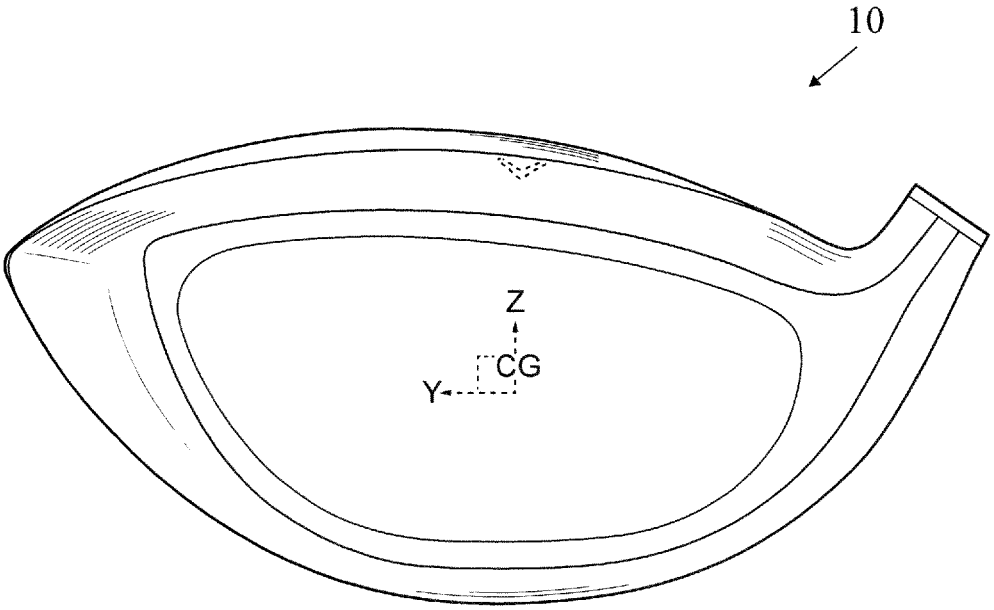
FIG. 42 is a front elevation view of a golf club head showing a CG location.

The axes of inertia are designated X, Y and Z, as shown in FIGS. 41-42. The X axis extends from the striking plate insert through the center of gravity, CG, and to the rear of the golf club head 10. The Y axis extends from the toe end of the golf club head 10 through the center of gravity, CG, and to the heel end of the golf club head 10. The Z axis extends from the crown through the center of gravity, CG, and to the sole.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 10 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 10 of the present invention is preferably greater than 4000 g-cm$^2$, and more preferably greater than 5000 g-cm$^2$, and preferably ranges from 4500 g-cm$^2$ to 6000 g-cm$^2$. The moment of inertia, Iyy, about the Y axis for the golf club head 10 of the present invention is preferably in the range from 2500 g-cm$^2$ to 4000 g-cm$^2$, more preferably from 3000 g-cm$^2$ to 3500 g-cm$^2$. The moment of inertia, Ixx, about the X axis for the golf club head 10 of the present invention is preferably in the range from 2000 g-cm$^2$ to 3500 g-cm$^2$, more preferably from 2500 g-cm$^2$ to 3300 g-cm$^2$.

At least one of the products of inertia (Iyz and Ixz) of the golf club head have an absolute value below 300 g-cm$^2$. Preferably, the absolute value of the products of inertia Iyz is preferably between 50 g-cm$^2$ and 200 g-cm$^2$, and most preferably between 50 g-cm$^2$ and 125 g-cm$^2$.

A more detail discussion of the products of inertia is disclosed in Cackett et al., U.S. Pat. No. 6,669,580 for a Golf Club Head That Optimizes Products Of Inertia, which is hereby incorporated by reference in its entirety.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

Seluga et al., U.S. Pat. No. 9,757,629 for a Golf Club Head Having Stress Reducing Features is hereby incorporated by reference in its entirety.

Seluga et al., U.S. Pat. No. 9,776,058 for a Golf Club Head Having Optimized Ball Speed To CT Relationship is hereby incorporated by reference in its entirety.

Seluga et al., U.S. Pat. No. 11,433,281 for a Method For Manufacturing Golf Club Head Having Stress Reducing Features is hereby incorporated by reference in its entirety.

Gibbs et al., U.S. Pat. No. 11,433,282 for a Method For Manufacturing Golf Club Head Having Stress Reducing Features is hereby incorporated by reference in its entirety.

Davis et al., U.S. Pat. No. 11,400,349 for Golf Club Head With Heel And Toe Stiffeners is hereby incorporated by reference in its entirety.

Nunez et al., U.S. Pat. No. 11,364,423 for a Golf Club Head Having Stress Reducing Features is hereby incorporated by reference in its entirety.

DeMille et al., U.S. Pat. No. 11,331,544 for Binder Jet Printed Golf Club Components With Lattice Structures is hereby incorporated by reference in its entirety.

Westrum et al., U.S. Pat. No. 11,090,534 for a Golf Club Head Comprising Microscopic Bubble Material is hereby incorporated by reference in its entirety.

Frederickson, U.S. Pat. No. 11,083,939 for a Golf Club Head With Adjustable Sole Weight is hereby incorporated by reference in its entirety.

Del Rosario et al., U.S. Pat. No. 11,027,176 for a Golf Club Head With Hosel Support Structurel is hereby incorporated by reference in its entirety.

Hanhart et al., U.S. Pat. No. 10,912,970 for a Golf Club Head Having Adjustable Stress Reducing Features is hereby incorporated by reference in its entirety.

Frederickson, U.S. Pat. No. 10,716,984 for a Golf Club Head With Adjustable Center Of Gravity is hereby incorporated by reference in its entirety.

DeMille et al., U.S. Pat. No. 10,105,579 for a Golf Club Head With A Compression-Molded, Thin-Walled Aft-Body is hereby incorporated by reference in its entirety.

Seluga, U.S. Pat. No. 10,099,096 for a Golf Club Head With Center Of Gravity Adjustability That Optimizes Products Of Inertia is hereby incorporated by reference in its entirety.

Seluga, U.S. Pat. No. 9,968,834 for a Golf Club Head With Adjustable Center Of Gravity is hereby incorporated by reference in its entirety.

DeMille et al., U.S. Pat. No. 9,283,447 for a Golf Club Head With Composite Face is hereby incorporated by reference in its entirety.

Griffin et al., U.S. Pat. No. 9,381,409 for a Multiple Material Iron is hereby incorporated by reference in its entirety.

DeMille et al., U.S. Pat. No. 9,387,373 for a Golf Club Head With Composite Weight Port is hereby incorporated by reference in its entirety.

Rice et al., U.S. Pat. No. 9,468,819 for a Golf Club Head is hereby incorporated by reference in its entirety.

U.S. Pat. No. 10,238,933 is hereby incorporated by reference in its entirety.

U.S. Pat. No. 9,259,627 is hereby incorporated by reference in its entirety.

U.S. Pat. No. 9,180,349 is hereby incorporated by reference in its entirety.

U.S. Pat. No. 8,834,294 is hereby incorporated by reference in its entirety.

U.S. Pat. No. 9,352,199 is hereby incorporated by reference in its entirety.

U.S. Pat. No. 9,067,110 is hereby incorporated by reference in its entirety.

U.S. Pat. No. 9,345,936 is hereby incorporated by reference in its entirety.

U.S. Pat. No. 8,956,244 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A component for a golf club head comprising:

a crown portion composed of a continuous carbon fiber reinforced epoxy material, wherein the crown portion has a thickness ranging from 0.025 inch to 0.040 inch; and a sole portion composed of a chopped carbon fiber reinforced vinyl ester sheet molding compound material, the sole portion having a thickness ranging from 0.040 inch to 0.240 inch;

wherein the crown portion is attached to the sole portion;

wherein the component has a front opening and a rear opening with a hollow interior.

2. The component according to claim 1 wherein the sole portion is thicker than the crown portion.

3. The component according to claim 1 wherein the first carbon based material has continuous fibers and the second carbon based material has chopped fibers.

4. The component according to claim 1 wherein the sole portion has a toe edge wall and a heel edge wall.

5. The component according to claim 1 wherein the crown portion has a radius of curvature.

6. The component according to claim 1 wherein the sole portion has a plurality of facets.

7. A golf club head comprising:

a face component;

a central body component comprising a crown portion composed of a continuous carbon fiber reinforced epoxy material, wherein the crown portion has a thickness ranging from 0.025 inch to 0.040 inch, a sole portion composed of a chopped carbon fiber reinforced vinyl ester sheet molding compound material, the sole portion having a thickness ranging from 0.040 inch to 0.240 inch, wherein the crown portion is attached to the sole portion, wherein the component has a front opening and a rear opening with a hollow interior;

an aft-component;

wherein the face component is attached to a front opening of the central body and the aft component is attached to a rear opening of the central body.

8. The golf club head according to claim 7 wherein the face component is composed of a metal material.

9. The golf club head according to claim 7 wherein the face component is composed of a titanium alloy material.

10. The golf club head according to claim 7 wherein the aft-component is composed of a metal material.

* * * * *